US005829355A

United States Patent [19]

Spengler

[11] Patent Number: 5,829,355

[45] Date of Patent: Nov. 3, 1998

[54] PROCESS AND APPARATUS FOR ELECTROSTATIC SUBSTANCE TRANSFER

[75] Inventor: Walter Spengler, Biel-Benken, Switzerland

[73] Assignee: Spengler Electronic AG, Biel-Benken, Switzerland

[21] Appl. No.: 698,845

[22] Filed: Aug. 16, 1996

[30] Foreign Application Priority Data

Aug. 18, 1995 [CH] Switzerland ..... 02 370/95
Mar. 14, 1996 [CH] Switzerland ..... 00675/96

[51] Int. Cl.[6] ..... B41M 35/14; B05B 5/025

[52] U.S. Cl. ..... 101/489; 101/153; 101/170; 118/620

[58] Field of Search ..... 101/489, 150, 101/483, 170, DIG. 7, 349, 153; 118/30.1, 620, 623

[56] References Cited

U.S. PATENT DOCUMENTS

| | | | |
|---|---|---|---|
| 2,483,462 | 10/1949 | Huebner | 101/426 |
| 2,558,901 | 7/1951 | Hooper | 101/426 |
| 3,443,517 | 5/1969 | Gundlach | 101/216 |
| 3,661,081 | 5/1972 | Wright | 101/426 |
| 3,738,266 | 6/1973 | Maeda et al. | 101/153 |
| 4,440,082 | 4/1984 | Carey et al. | 101/170 |
| 4,697,514 | 10/1987 | George et al. | 101/170 |
| 5,138,345 | 8/1992 | Tohyama et al. | 346/140 R |

FOREIGN PATENT DOCUMENTS 608902 9/1948 United Kingdom .

*Primary Examiner*—Edgar Burr
*Assistant Examiner*—Dave A Ghatt
*Attorney, Agent, or Firm*—Bell Seltzer Intellectual Property Law Group of Alston & Bird, LLP

[57] ABSTRACT

A process and an apparatus for electrostatic substance transfer are proposed. A substance (4, 4') is taken from a substance container (9) by a substance transfer roller (1) and transferred onto a printing form cylinder (2). In order to improve the substance transfer, the printing form cylinder (2) is subjected to local negative charging by means of a spray electrode (6) near to the region in which the substance transfer takes place. The substance (4) is subsequently transferred from the printing form cylinder (2) onto a medium (7) which is pressed against the printing form cylinder (2) by a back-pressure cylinder (3).

15 Claims, 4 Drawing Sheets

PROCESS AND APPARATUS FOR ELECTROSTATIC SUBSTANCE TRANSFER

The present invention relates to a process for electrostatic substance transfer, in which a substance is transferred from a substance transfer roller onto a printing forme cylinder and from there onto a medium which is pressed against the printing forme cylinder by a back-pressure cylinder, and to an apparatus for carrying out this process.

Processes for applying a substance to a medium are known, in particular from printing technology, in which a substance is transferred from a substance transfer roller onto a printing forme cylinder and from there onto the medium which is pressed against the printing forme cylinder by a back-pressure cylinder. In this case, the substance transfer roller, the printing forme cylinder and the back-pressure cylinder can vary in many different ways and depend, inter alia, on the substance, on the medium and on the desired application quality.

To improve the printing quality, that is the application of ink to the medium, electrostatic printing aids which can have various configurations are used in intaglio printing. For example, an intaglio printing process with an associated apparatus is described in DE-Patent 1,571,839, in which an electric field is generated by applying an electric charge against the back-pressure cylinder, which electric field passes through the medium at the drawing-in gap between the back-pressure cylinder and the printing forme cylinder which exhibits wells, and by means of which electric field an induced charge is imposed on the printing ink in the wells at the drawing-in gap, the charge being of such a size that the surface-tension forces which hold the printing ink in the wells are overcome.

It is furthermore known, at least from U.S. Pat. No. 2,408,144, that electrostatic printing aids can also be used in letterpress printing or in planographic printing.

All these known electrostatic printing aids are used for generating an electric field between the printing forme cylinder and the back-pressure cylinder, which electric field passes through the medium at this point so that the printing ink is transferred from the printing forme cylinder onto the medium in an improved manner. The printing processes known up to now in which such electro-static printing aids are used have the disadvantage that the printing quality achieved can be insufficient due to the fact that the printing forme cylinder does not receive a sufficient supply of printing ink.

SUMMARY OF THE INVENTION

The invention is based on the object of providing a process and an apparatus for electrostatic substance transfer, which guarantee a qualitatively satisfactory substance transfer from the substance transfer roller up to the medium. As substance, it should be possible also to use a wide variety of other powdery or liquid substances in addition to printing ink and, as a medium, also a wide variety of other materials in addition to paper and card.

This object is on the one hand achieved by the process according to the invention for electrostatic substance transfer in printing operations, said process comprising the steps of transferring a substance from a substance transfer roller onto a printing cylinder; transferring the substance from the printing cylinder onto a medium which is pressed against the printing cylinder by a back-pressure cylinder; and charging the printing cylinder locally near to the region in which the substance is transferred from the substance transfer roller onto the printing cylinder.

On the other hand, this object is achieved by the apparatus according to the invention for electrostatic substance transfer, in printing operations, the apparatus comprising a substance transfer roller; a printing cylinder adjacent to the roller so that a substance is transferred from the roller onto the printing cylinder; a back-pressure cylinder adjacent to the printing cylinder for nipping a medium therebetween so that the substance is transferred from the printing cylinder to the medium; and a charging device positioned adjacent to the printing cylinder and the substance transfer roller for charging the printing cylinder locally near to the region in which the substance is transferred from the substance transfer roller onto the printing cylinder.

Preferred embodiments emerge from the dependent patent claims. The essence of the invention consists in the fact that a printing forme cylinder is charged locally near to the region in which it is supplied with a substance by a substance transfer roller, such that the substance transfer from the substance transfer roller onto the printing forme cylinder is improved by means of an electric field in the transfer region.

It is now possible by virtue of the invention to apply a wide variety of substances to a wide variety of media in a satisfactory quality.

BRIEF DESCRIPTION OF THE DRAWINGS

Embodiments of the process according to the invention and of the apparatus according to the invention for electrostatic substance transfer are described in greater detail below with reference to the attached drawings, in which.

DETAILED DESCRIPTION OF THE PREFERRED EMBODIMENTS

Figure 1:
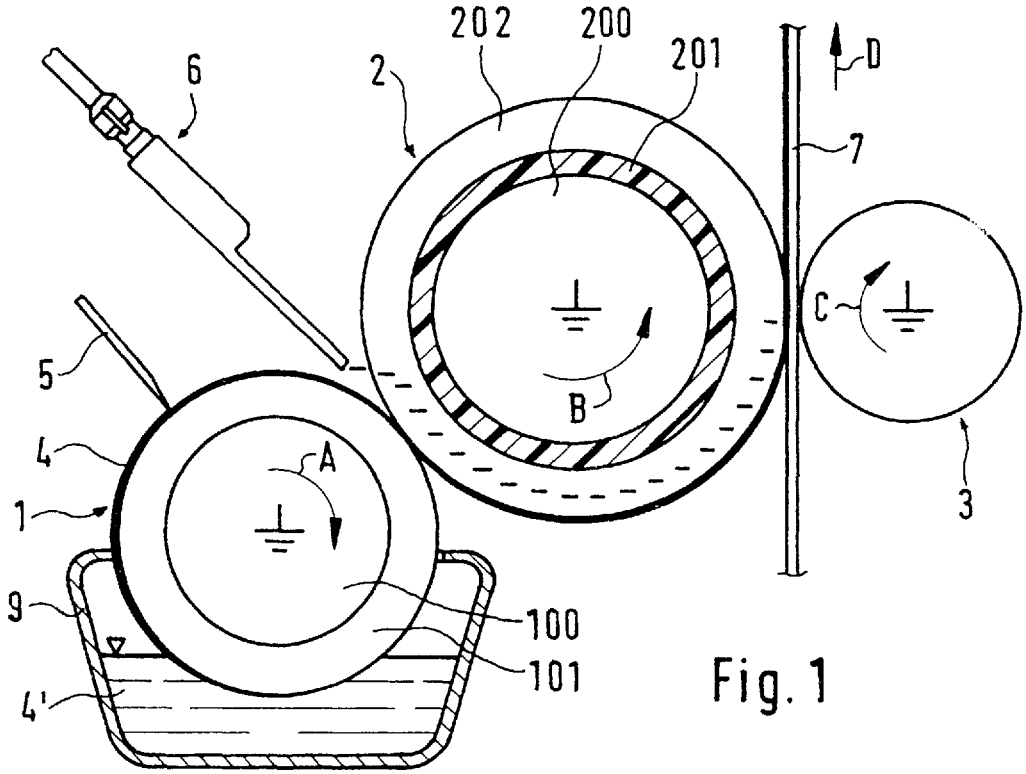
FIG. 1 shows a diagrammatic sectional view of a substance transfer apparatus with a vertically guided medium and a spray electrode for the local charging of the printing forme cylinder.

As shown in FIG. 1, a cylindrical substance transfer roller 1 is arranged in such a way that its lower part protrudes into a substance container 9 and dips into the substance 4'. The substance 4' may consist of printing ink, varnish, priming ink or varnish, a cold sealing compound, glue, wax, etc. The substance transfer roller 1 is grounded and has a core 100 and a casing 101 whose surface may be screened, embossed or smooth. During the rotation of the substance transfer roller 1 in the direction of the arrow A, the substance 4 is carried along on the outer surface emerging from the substance 4'. A doctor blade 5 is used to control the required substance quantity in the case of screened or embossed substance transfer rollers 1, which doctor blade strips off the superfluous substance 4. In the case of apparatuses which do not have a screened or embossed substance transfer roller, the substance quantity is controlled by means of a differentiated contact pressure of the substance transfer roller against the printing forme cylinder.

Arranged resting against and axially parallel to he substance transfer roller 1 is a printing forme cylinder 2 which rotates in the direction of the arrow B during the rotation of the substance transfer roller 1 in the direction of the arrow A. The printing forme cylinder 2 has a grounded core 200, an insulating inner casing 201 and a semiconducting outer casing 202. The insulating inner casing 201 preferably has a resistivity greater than 1 GΩcm, whereas the semiconducting outer casing 202 has a resistivity of between 0.5 MΩcm and 50 MΩcm, preferably between 0.5 MΩcm and 10 MΩcm. The outer casing 202 may consist of various materials, e.g. of rubber, plastic or metal, depending on the substance 4 to be transferred. When using the apparatus as a printing apparatus, it contains the desired full-tone or half-tone image, e.g. engraved in the rubber or as a mounted photopolymer printing block.

The substance transfer from the substance transfer roller 1 onto the printing forme cylinder 2 takes place in the so-called substance transfer region which comprises the region where the printing forme cylinder 2 rests against the substance transfer roller 1. In order to achieve an improved substance transfer, the printing forme cylinder 2 is subjected to local negative charging by means of a spray electrode 6 near to the substance transfer region, so that Rn electric field is built up in the substance transfer region. The spray electrode 6 is of swordlike configuration, that is it has an elongated edge which carries out the charging of the printing forme cylinder 2 over the entire length of the desired region. It is arranged in such a way that the charging of the printing forme cylinder 2 takes place from the outside without causing the adjacent substance transfer roller 1 likewise to be charged. The voltage of the spray electrode required for optimum substance transfer depends on how far away from the substance transfer region the printing forme cylinder 2 is locally charged. If the spray electrode is positioned very near to the substance transfer regions about 2000 V are required; in contrast, if it is not positioned near to the substance transfer region, about 8000 V are required. The voltage is usually between about 2500 V and about 2800 V. the optimum positioning of the spray electrode 6 and the optimum setting of the spray-electrode voltage can be carried out without difficulty by a person skilled in the art. In comparison with the previously known printing processes, in which electrostatic printing aids are used, far lower feed voltages are thus required for the charging device owing to the targeted local charging.

A grounded back-pressure cylinder 3 is arranged axially parallel to the printing forme cylinder 2 in such a way that it presses a medium 7 against the printing forme cylinder 2. During the rotation of the printing forme cylinder 2 in the direction of the arrow B, the back-pressure cylinder 3 rotates in the direction of the arrow C, and the medium 7 moves upwards in the direction of the arrow D. The locally charged part of the printing forme cylinder 2 and the substance 4 adhering to its surface are likewise carried along during this rotation. In the region where the back-pressure cylinder 3 presses the medium, against the printing forme cylinder 2, a second electric field is thus built up which passes through the medium 7. This guarantees a good substance transfer from the printing forme cylinder 2 onto the medium 7.

The following stipulation applies to the entire further description. If reference numerals are contained in R figure for the purpose of clarity in the drawing, but are not explained in the directly associated description, reference is made to their mention in preceding descriptions of figures.

Figure 2:
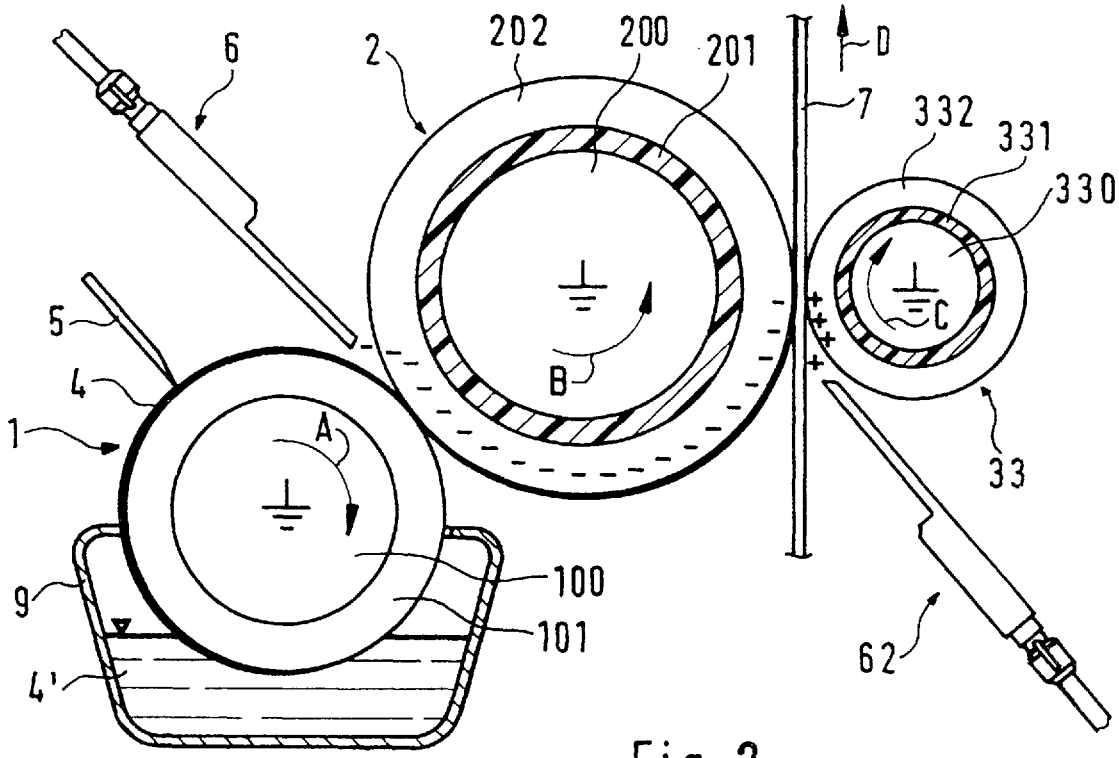
FIG. 2 shows a diagrammatic sectional view of a substance transfer apparatus according to FIG. 1 with an additional spray electrode for the local charging of the back-pressure cylinder.

As shown in FIG. 2, if the substance transfer from the printing forme cylinder 2 onto the medium 7 in the embodiment described in conjunction with FIG. 1 is insufficient, which may be the case, for example, with a strongly insulating medium 7, instead of the grounded back-pressure cylinder 3 mentioned, 1 back-pressure cylinder 33 may be used, which is subjected to local positive charging by means of a second spray electrode 62, so that the electric field is intensified in the region where the back-pressure cylinder 33 presses the medium 7 against the printing forme cylinder 2.

The back-pressure cylinder 33 has a grounded core 330, an insulating inner casing 331 and a semiconducting outer casing 332. The insulating inner casing 331 preferably has a resistivity greater than 1 GΩcm, whereas the semiconducting outer casing 332 has a resistivity of between 0.5 MΩcm and 50 MΩcm, preferably between 0.5 MΩcm and 10 MΩcm.

The spray electrode 62 is of the same construction as the spray electrode 6 and the statements made in conjunction with the spray electrode 6 apply to the positioning and the spray-electrode voltage.

Figure 3:
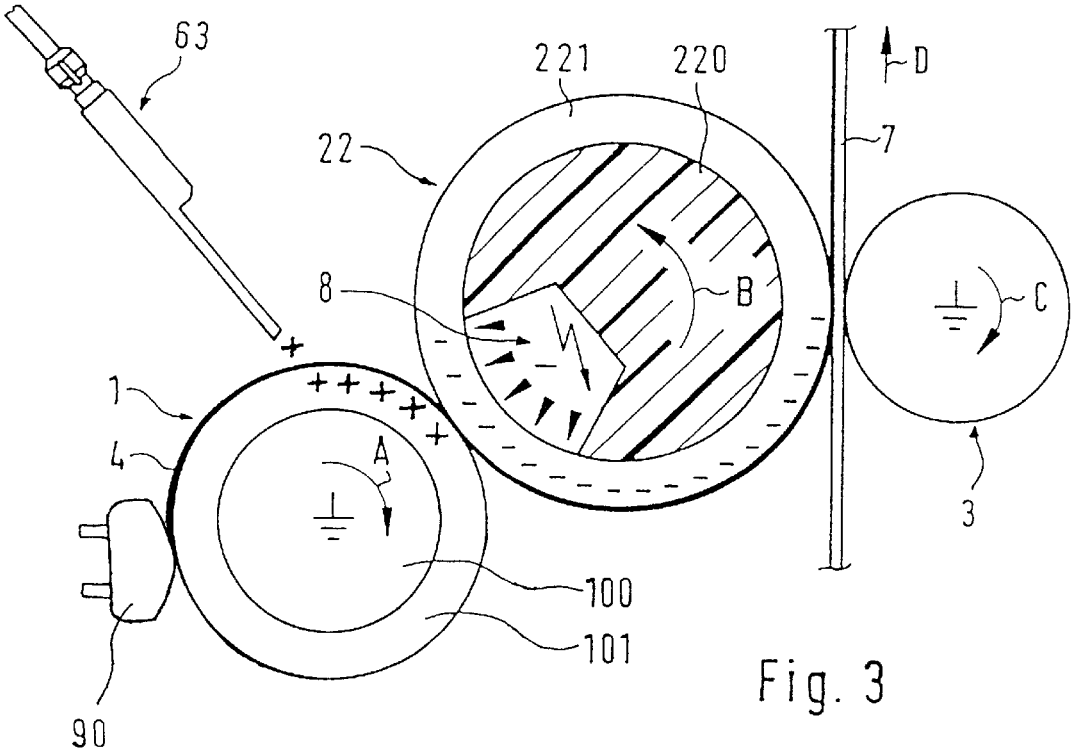
FIG. 3 shows a diagrammatic sectional view of a substance transfer apparatus with a vertically guided medium, with a spray electrode for the local charging of the substance transfer roller and with conductive tips arranged inside the printing forme cylinder for the local charging thereof.

As shown in FIG. 3, differing from the embodiment described in conjunction with FIG. 1, the printing forme cylinder 22 is subjected to local negative charging by means of a multiplicity of conducting tips 8 from the inside and not by means of a spray electrode from the outside.

The printing forme cylinder 22 has an insulating core 220 and a semiconducting casing 221. The insulating core 220 preferably has a resistivity greater than 1 GΩcm, whereas the semiconducting casing 221 preferably has a resistivity of between 20 MΩcm and 50 MΩcm.

Instead of being immersed in the substance 4' present in the substance container 9, the substance transfer roller 1 is here provided with substance by means of a substance cartridge 90. In order to improve the substance transfer from the cartridge 90 onto the substance transfer roller 1, the substance cartridge 90 is advantageously grounded, and the substance transfer roller 1 is charged at least near to the region in which the substance transfer takes place. For this purpose, the outermost layer of casing of the substance transfer roller 1 is designed to be conducting or semiconducting. The charging then takes place either via the printing forme cylinder or locally by means of a charging device which comprises in the present case a spray electrode 63, or, for example, a conducting roller, a conducting brush or conducting tips arranged inside the substance transfer roller.

Figure 4:
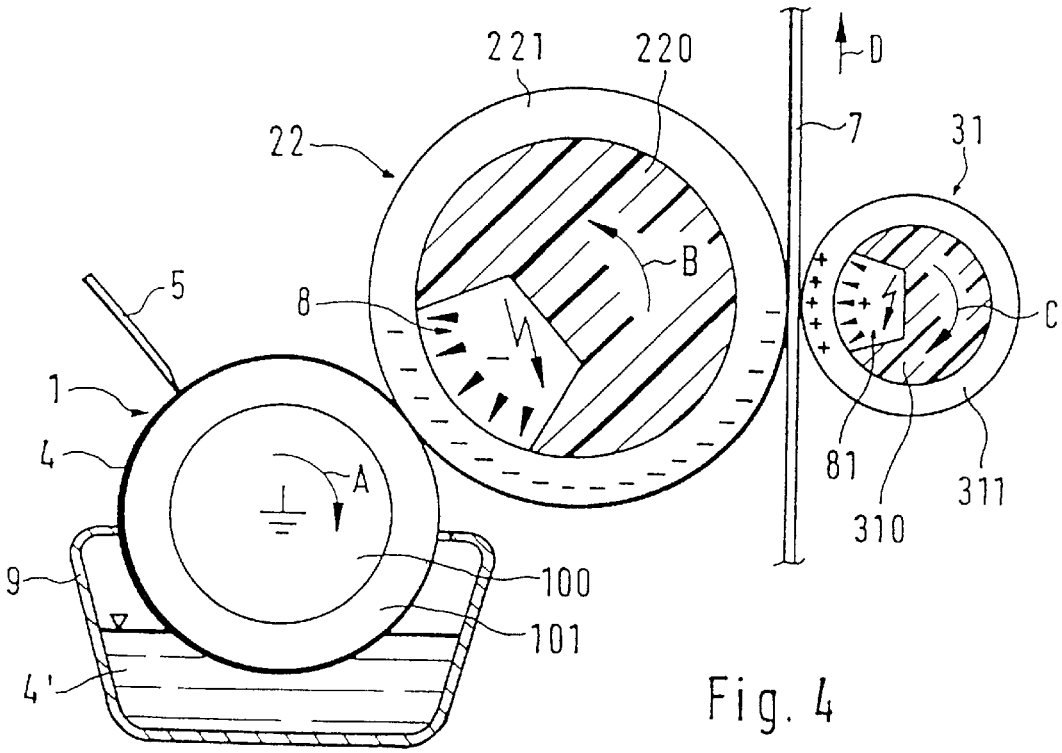
FIG. 4 shows a diagrammatic sectional view of a substance transfer apparatus according to FIG. 3 with additional conductive tips arranged inside the back-pressure cylinder for the local charging thereof.

As shown in FIG. 4, if the substance transfer from the printing forme cylinder 22 onto the medium 7 in the embodiment according to FIG. 3 is insufficient, which may be the case, for example, with a strongly insulating medium 7, instead of the grounded back-pressure cylinder 3 a back-pressure cylinder 31 may be used, which is subjected to local positive charging by means of a multiplicity of conducting tips 81 from the inside, so that the electric field is intensified in the region where the back-pressure cylinder 31 presses the medium 7 against the printing forme cylinder 22.

The back-pressure cylinder 31 has an insulating core 310 and a semiconducting casing 311. The insulating core 310 preferably has a resistivity greater than 1 GΩcm, whereas the semiconducting casing 311 preferably has a resistivity of between 20 MΩcm and 50 MΩcm.

Figure 5:
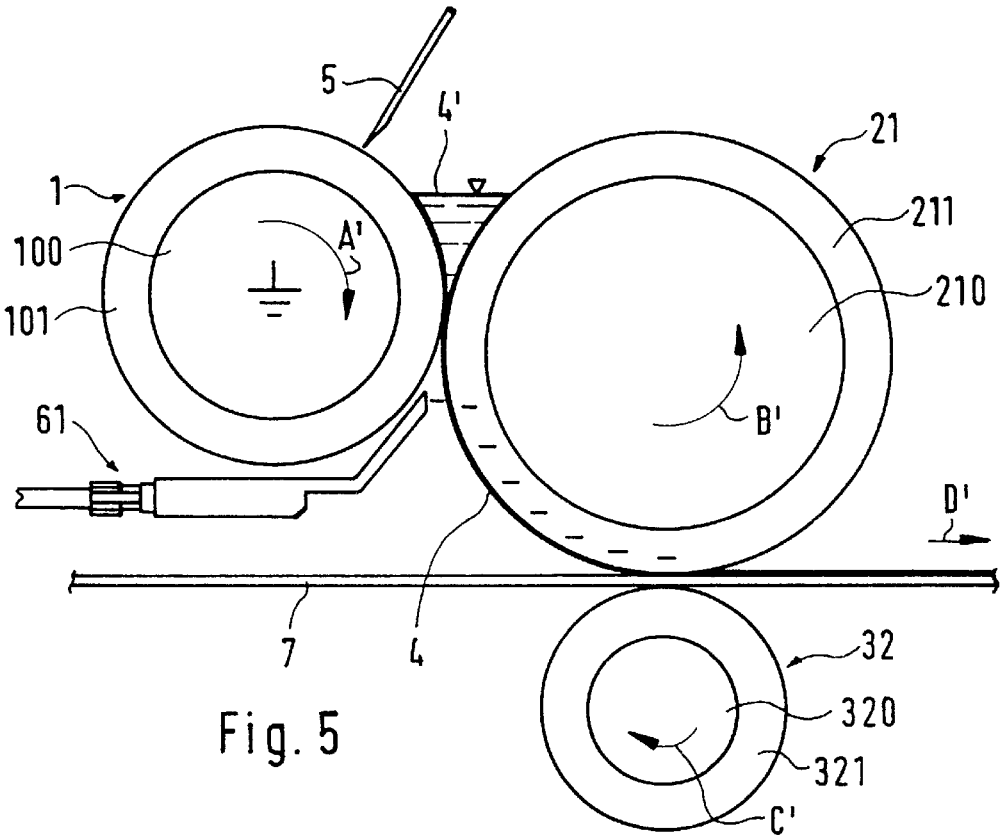
FIG. 5 shows a diagrammatic sectional view of a substance transfer apparatus with a horizontally guided medium an a spray electrode for the local charging of the printing forme cylinder.

As shown in FIG. 5, in this embodiment, substance 4' present between the substance transfer roller 1 and the printing forme cylinder 21 is transferred onto the printing forme cylinder 21 luring the rotation of the substance transfer roller 1 in the direction of the arrow A' and rotation of the printing forme cylinder 21 in the direction of the arrow B'. The required quantity of substance transferred can be controlled by means of the contact pressure of the substance transfer roller 1 against the printing forme cylinder 21.

In order to achieve an improved substance transfer, again the printing forme cylinder 21 is subjected to local negative charging by means of a spray electrode 61 near to i the substance transfer region, so that an electric field is built up in the substance transfer region. However, in this embodiment, the spray electrode 61 must be positioned below the substance transfer region, so that the charged region of the printing forme cylinder 21 is not turned towards the substance transfer region by the rotation of the printing forme cylinder 21, but is turned away from the said substance transfer region, which necessitates a higher spray-electrode voltage. In order to allow the arrangement of the spray electrode 61 between the medium 7 and the substance transfer region, the said spray electrode is of bent configuration.

The printing forme cylinder 21 has an insulating core 210 and a semiconducting casing 211. The insulating core 210 preferably has a resistivity greater than 1 GΩcm, whereas the semiconducting casing 211 has a resistivity of between 0.5 MΩcm and 50 MΩcm, preferably between 0.5 MΩcm D and 10 MΩcm.

A back-pressure cylinder 32 which comprises an insulating core 320 and a grounded casing 321 is arranged axially parallel to the printing forme cylinder 21 in such a way that it presses a medium 7 against the printing forme cylinder 21. During the rotation of the printing forme cylinder 21 in the direction of the arrow B', the back-pressure cylinder 32 rotates in the direction of the arrow ~', and the medium 7 moves in the direction of the arrow D'. The locally charged part of the printing forme cylinder 21 and the substance 4 adhering to its surface are likewise carried along during this rotation. In the region where the back-pressure cylinder 32 presses the medium 7 against the printing forme cylinder 21, a second electric field is thus built up which passes through the medium 7. This guarantees a good substance transfer from the printing forme cylinder 21 onto the medium 7.

Figure 6:
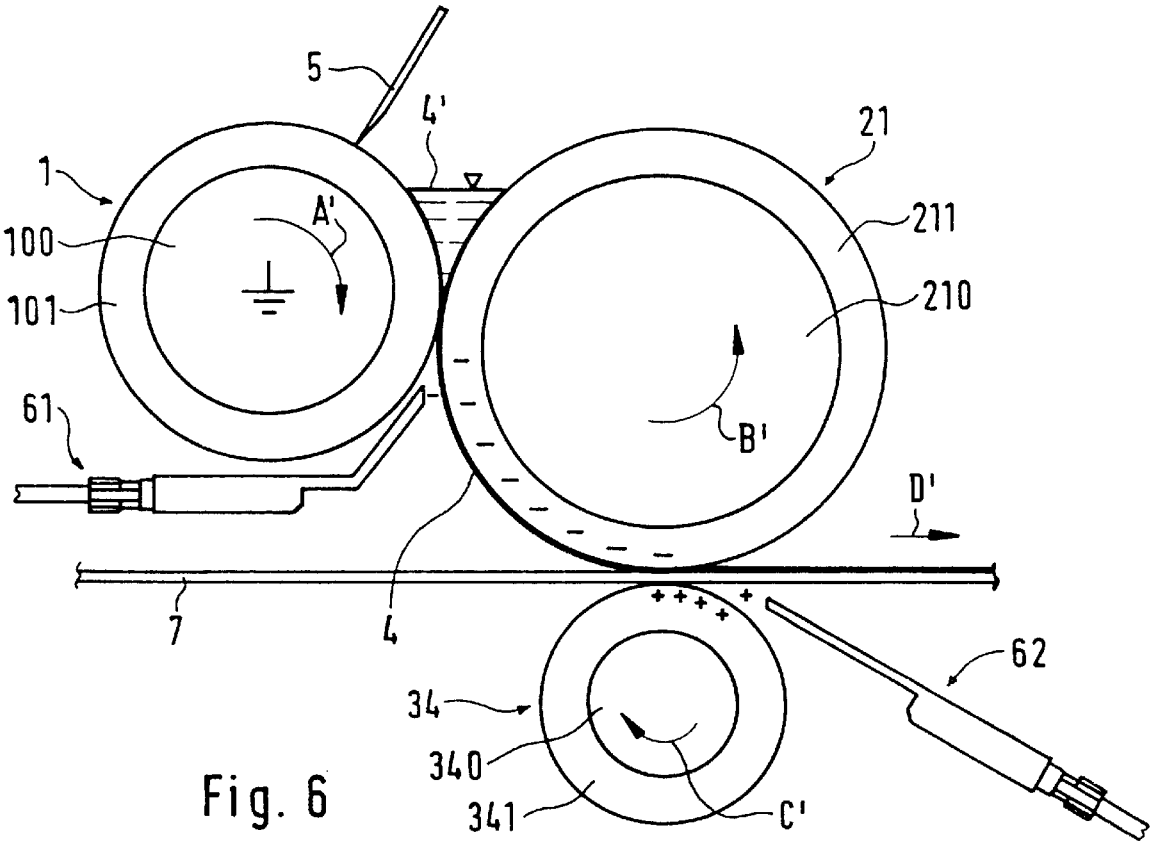
FIG. 6 shows a diagrammatic sectional view of a substance transfer apparatus according to FIG. 5 with an additional spray electrode for the local charging of the back-pressure cylinder.

As shown in FIG. 6, if the substance transfer from the printing forme cylinder 21 onto the medium 7 in the embodiment described in conjunction with FIG. 5 is insufficient, which may be the case, for example, with a strongly insulating medium 7, instead of the back-pressure cylinder 32 mentioned a back-pressure cylinder 34 may be used, which is subjected to local positive charging by means of a second spray electrode 62, so that the electric field is intensified in the region where the back-pressure cylinder 34 presses the medium 7 against the printing forme cylinder 21.

The back-pressure cylinder 34 has an insulating core 340, and a semiconducting casing 341. The insulating core 340 preferably has a resistivity greater than 1 GΩcm, whereas the semiconducting casing 341 has a resistivity of between 0.5 MΩcm and 50 MΩcm preferably between 0.5 MΩcm and 10 MΩcm.

The spray electrode 62 is of the same construction as the spray electrode 6 and the statements made in conjunction with the spray electrode 6 apply to the positioning and the spray-electrode voltage.

Figure 7:
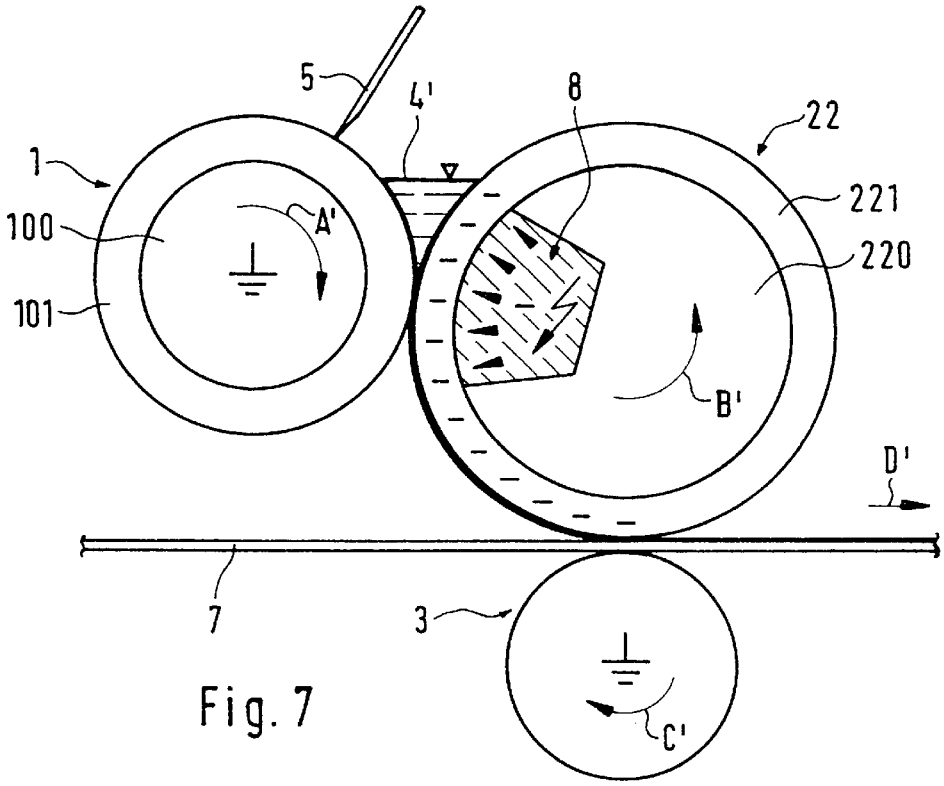
FIG. 7 shows a diagrammatic sectional view of a substance transfer apparatus with a horizontally guided medium and with conductive tips arranged inside the printing forme cylinder for the local charging thereof.

As shown in FIG. 7, differing from the embodiment described in conjunction with FIG. 5, the printing forme cylinder 22 is subjected to local negative charging by means of a multiplicity of conducting tips 8 from the inside and not by means of a spray electrode from the outside.

The printing forme cylinder 22 has an insulating core 220 and a semiconducting casing 221. The insulating core 220 preferably has a resistivity greater than 1 GΩcm, whereas the semiconducting casing 221 preferably has a resistivity of between 20 MΩcm and 50 MΩcm.

Instead of the back-pressure cylinder 32, the back-pressure cylinder used can be a grounded back-pressure cylinder 3, as illustrated.

Figure 8:
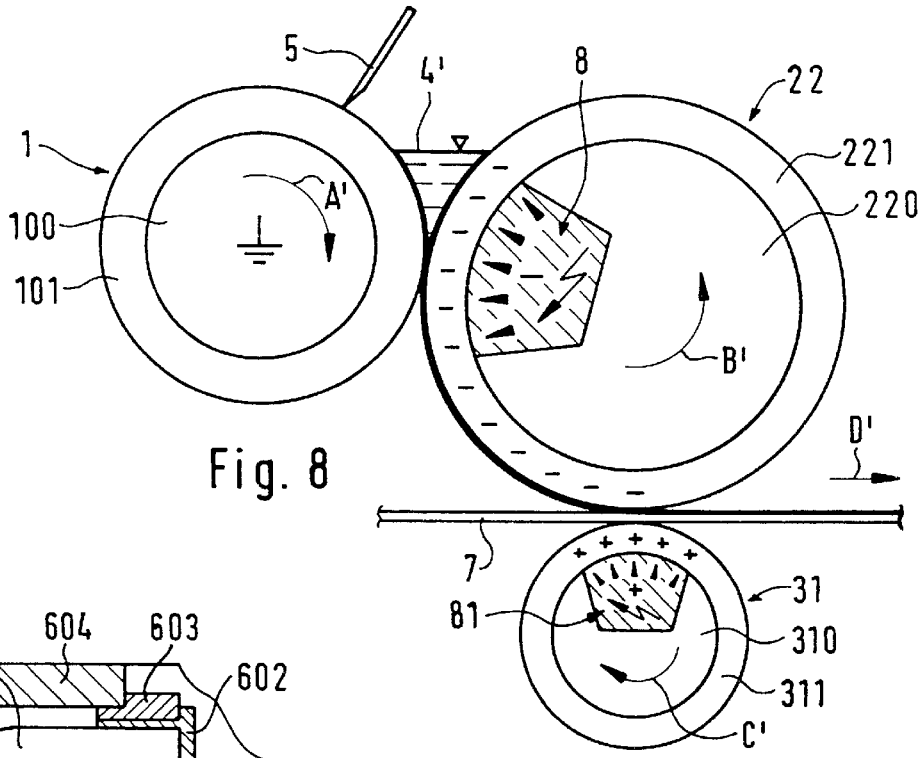
FIG. 8 shows a diagrammatic sectional view of a substance transfer apparatus according to FIG. 7 with additional conductive tips arranged inside the back-pressure cylinder for the local charging thereof and FIG. 9 shows a longitudinal section of the front part of a spray electrode.

As shown in FIG. 8, if the substance transfer from the printing forme cylinder 22 onto the medium 7 in the embodiment according to FIG. 7 is insufficient, which may be the case, for example, with a strongly insulating medium 7, instead of the grounded back-pressure cylinder 3 a back-pressure cylinder 31 may be used, which is subjected to local positive charging by means of a multiplicity of conducting tips 81 from the inside, so that the electric field is intensified in the region where the back-pressure cylinder 31 presses the medium 7 against the printing forme cylinder 22.

The back-pressure cylinder 31 has an insulating core 310 and a semiconducting casing 311. The insulating core 310 preferably has a resistivity greater than 1 GΩcm, whereas the semiconductivity casing 311 preferably has a resistivity of between 20 MΩcm and 50 MΩcm.

Figure 9:
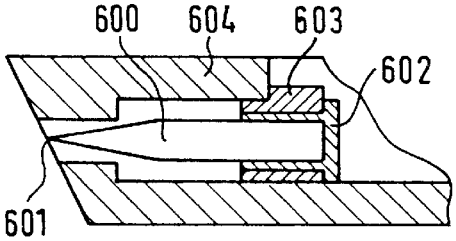

As shown in FIG. 9, the front part of the spray electrodes 6, 61, 62 used has, as the charge-transmitting part, an elongated sword 600 with an edge 601. The sword 600 is attached to a support element 603 by means of a brass sleeve 602 and is mounted in a housing 604 which is open towards the front and is of a bevelled configuration. As a result, the charging spray is limited to a specific angular range.

In addition to the processes and apparatuses for electrostatic substance transfer described above, further variations can be implemented. Those mentioned specifically here are:

The local charging of the printing forme cylinder or of the back-pressure cylinder can be realized with other devices than the charging devices mentioned. The spray electrodes 6, 61, 62 mentioned do not necessarily have to be of swordlike configuration. Charging from the outside can be carried out, for example, by means of a multiplicity of tips.

The printing forme cylinder 2, 21, 22 can also be subjected to positive instead of negative local charging. The back-pressure cylinder 31, 33 is then required. The printing forme cylinder and the back-pressure cylinder do not have to be charged locally using the same type of charging device. The printing forme cylinder can be charged, for example, from the outside by means of a spray electrode and the back-pressure cylinder from the inside by means of conducting tips. Any desired combinations are possible.

The substance transfer roller, the printing forme cylinder and the back-pressure cylinder can also be constructed differently than in the embodiments described. In particular, they can have additional layers.

I claim:

1. A process for printing a printing substance onto a medium, said process comprising the steps of:

transferring the printing substance from a substance transfer roller onto a printing cylinder at a nip formed therebetween;

transferring the printing substance from the printing cylinder onto a medium which is pressed against the printing cylinder by a back-pressure cylinder; and directing a charge towards the nip in which the printing substance is transferred from the substance transfer roller onto the printing cylinder to aid transfer of the printing substance onto the printing cylinder.

2. A process according to claim 1 further comprising the step of charging the back-pressure cylinder at the region in which the back-pressure cylinder presses the medium against the printing cylinder with a charge of an opposite sign to the charge of the printing cylinder.

3. A process according to claim 1 further comprising the step of transferring the substance from a substance cartridge to the substance transfer roller.

4. A process according to claim 3 further comprising the step of charging the substance transfer roller at the region in which the substance is transferred from the substance cartridge onto the substance transfer roller.

5. A process according to claim 1 wherein said step of transferring a substance from the printing cylinder onto a medium comprises transferring a substance selected from the group consisting of printing ink, varnish, priming ink, cold sealing compound, glue and wax from the printing cylinder onto a medium selected from the group consisting of paper, card, foil, plastic, wood, glass, aluminum and a material coated with aluminum.

6. An apparatus for printing a printing substance onto a medium comprising:

a substance transfer roller;

a printing cylinder adjacent to said roller so that the printing substance is transferred from said roller onto said printing cylinder at a nip formed therebetween;

a back-pressure cylinder adjacent to said printing cylinder for nipping a medium therebetween so that the printing substance is transferred from said printing cylinder to the medium; and a spray electrode positioned adjacent to said printing cylinder and said substance transfer roller for directing a charge towards the nip in which the printing substance is transferred from said substance transfer roller onto said printing cylinder to aid transfer of the printing substance onto the printing cylinder.

7. An apparatus according to claim 6 further comprising a charging device adjacent to said back-pressure cylinder for charging said back-pressure cylinder at the region in which the substance is transferred from said printing cylinder to the medium.

8. An apparatus according to claim 7 wherein said charging device comprises a spray electrode for charging the respective cylinder from outside of said cylinder.

9. An apparatus according to claim 7 wherein said charging device comprises conducting tips arranged inside the respective cylinder and adjacent to the respective substance transfer region for charging said cylinder from the inside.

10. An apparatus according to claim 6 further comprising a substance cartridge from which the substance is transferred to said substance transfer roller, and wherein said cartridge is grounded and said substance transfer roller comprises an outermost layer formed of a conducting or semiconducting material.

11. An apparatus for printing a printing substance onto a medium comprising:

a substance transfer roller;

a printing cylinder adjacent to said roller so that the printing substance is transferred from said roller onto said printing cylinder at a nip formed therebetween;

a back-pressure cylinder adjacent to said printing cylinder for nipping a medium therebetween so that the printing substance is transferred from said printing cylinder to the medium; and conducting tips positioned adjacent to said printing cylinder and said substance transfer roller for directing a charge towards the nip in which the printing substance is transferred from said substance transfer roller onto said printing cylinder to aid transfer of the printing substance onto the printing cylinder.

12. An apparatus according to claim 11 further comprising a charging device adjacent to said back-pressure cylinder for charging said back-pressure cylinder at the region in which the substance is transferred from said printing cylinder to the medium.

13. An apparatus according to claim 12 wherein said charging device comprises a spray electrode for charging the respective cylinder from outside of said cylinder.

14. An apparatus according to claim 12 wherein said charging device comprises conducting tips arranged inside the respective cylinder and adjacent to the respective substance transfer region for charging said cylinder from the inside.

15. An apparatus according to claim 11 further comprising a substance cartridge from which the substance is transferred to said substance transfer roller, and wherein said cartridge is grounded and said substance transfer roller comprises an outermost layer formed of a conducting or semiconducting material.

* * * * *